US005377711A

United States Patent [19]

Mueller

[11] Patent Number: 5,377,711

[45] Date of Patent: Jan. 3, 1995

[54] CAMOUFLAGE BLIND FOR HUNTERS

[76] Inventor: Mark Mueller, 3606 Central Ave., Catawissa, Mo. 63015

[21] Appl. No.: 724,856

[22] Filed: Jul. 2, 1991

[51] Int. Cl.[6] ..... E04H 15/00

[52] U.S. Cl. ..... 135/87; 43/1; 135/901; 135/115

[58] Field of Search ..... 135/91, 111, 900, 901, 135/902, 909, 115, 119; 43/1

[56] References Cited

U.S. PATENT DOCUMENTS

| | | | |
|---|---|---|---|
| Re. 26,140 | 1/1967 | Schoenike | 135/901 X |
| 2,015,588 | 9/1935 | Brown | 135/115 X |
| 2,051,643 | 8/1936 | Morrison | 135/115 X |
| 2,475,515 | 7/1949 | Potter | 135/115 X |
| 2,820,468 | 1/1958 | Park et al. | 135/115 X |
| 2,881,778 | 4/1959 | Goldman | 135/115 X |
| 3,323,530 | 6/1967 | Smith | 43/1 X |
| 3,642,318 | 2/1972 | Avant | 43/1 X |
| 3,943,953 | 3/1976 | Cantwell et al. | 135/117 X |
| 3,967,026 | 6/1976 | Dalblom | 135/115 X |
| 4,067,346 | 1/1978 | Husted | 135/901 X |
| 4,072,158 | 2/1978 | O'Brien et al. | 135/117 X |
| 4,077,417 | 3/1978 | Beavers | 135/117 X |
| 4,129,139 | 12/1978 | Powers | 135/117 X |
| 4,364,193 | 12/1982 | Visco | 135/98 X |
| 4,404,980 | 9/1983 | Wade | 135/117 X |
| 4,768,317 | 9/1988 | Markham | 135/117 X |
| 4,798,019 | 1/1989 | Sury et al. | 135/901 X |
| 4,858,635 | 8/1989 | Eppenbach | 135/117 X |
| 4,926,893 | 5/1990 | Klopfenstein et al. | 135/901 X |
| 5,010,909 | 4/1991 | Cleveland | 135/901 |

FOREIGN PATENT DOCUMENTS

| | | | |
|---|---|---|---|
| 0235954 | 6/1925 | United Kingdom | 135/902 |

*Primary Examiner*—Lanna Mai

*Attorney, Agent, or Firm*—Clifford A. Poff

[57] ABSTRACT

A blind apparatus to camouflage a person in a natural habitat particularly while hunting wild game such as turkey. A skeletal frame made up of tubular spacers joined with connectors to form top and bottom frame parts that are held apart by spacer poles. A light impervious casing is supported by the frame to form a top, back and opposed sides of the blind. A netting is supported along the entrance way of the blind by the frame and provided with open spaces sufficient to allow line of sight observations into the natural habitat outside of the blind and penetration of an arrow or ballistic of a fire arm.

15 Claims, 2 Drawing Sheets

CAMOUFLAGE BLIND FOR HUNTERS

BACKGROUND OF THE INVENTION

1. Field of the Invention:

This invention relates to a camouflage blind used by a sportsman and more particularly to such a blind that will obscure the presence of an individual while hunting, engaged in wild life photography or wild life observations.

In the natural habitat of wild animals man's presence usually brings about a self defensive reaction of flight by most animals to a different location. A person desiring to conceal their presence in the habitat of wild life is greatly benefitted if a certain degree of movement can be exercised particularly when a surveillance is undertaken for an extended period of time. It is further desirable that the person be afforded a degree of protection during inclement weather. The use of a camouflage blind must be obscured in the immediate surroundings and versatile to accommodate the user's need. For example, when the occupant in the blind is a sportsman there is a need to discharge a weapon at a game animal without disassembling part of the camouflage apparatus or without restricting the sportsman to a specifically designated access site where the projectile travels to the outside from the blend. A similar circumstance occurs with respect to the close-up observations of wild life. Vision must not be impaired by the blind to the extent that the blind must be disassembled to allow observation of the wild life. The blind for use in this manner must afford the user not only the ease of transportation to and from the observation site but also mobility for placement at various different locations. A need therefore exists for a versatile blind structure to camouflage the presence of a person in the natural habitat of wild animals. Of particular importance is the .ability to obscure the presence of turkey hunters in the wild. It has become a common practice for such hunters to wear not only camouflage clothing but also obscure their presence in the wild by numerous other camouflage techniques. In the hunting of turkey muscle fatigue is often experienced by the hunter when the camouflage measure requires the person to remain motionless for hours while calling game to a target range.

SUMMARY OF THE INVENTION

It is an object of the present invention to provide blind embodying construction and sufficient size for forming an enclosure for a person while forming a camouflage to the presence of the person.

A further object of the invention is to provide a blind to camouflage the presence of a person in a wild habitat in which the blind apparatus can be readily transported and moved in an operative state from place to place in the habitat.

It is a further object of the present invention to provide a blind to camouflage of existence of a person in which the apparatus affords the user a need to maintain continuous visual contact with a selected sight area as well as, when desired, to discharge a fire arm or an archery arrow from the blind from anywhere within a broad viewing window area without removal or displacement of any part of the blind.

More particularly according to the present invention there is provided a blind apparatus to camouflage the presence of a person in the natural habitat of wild game, the apparatus comprising of a skeletal frame including top and bottom rectangular frame parts vertically spaced by posts for defining a camouflage area for a person, a light impervious casing defining a top, a back and opposed sides supported by the skeletal frame for preventing emission of light by the casing from the camouflaged area; and a netting supported by the frame to form front enclosure on the skeletal frame while allowing window area for sight through openings in the netting for visual access to the natural habitat.

More particularly the blind apparatus of the present invention provides that the netting and casing includes camouflage coloration patches and that the casing embody a sewn construction that will allow placement and attachment to a skeletal frame through the use of fastening device such as a hook and pile fasteners. The casing is preferably impervious water and forms a sufficiently rigid structure when attached to the skeletal frame to allow a person within the blind to lift and move the blind from place to place.

BRIEF DESCRIPTION OF THE DRAWINGS

These features which are an advantage of the present invention, as well as other features, will be more fully understood when the following description is read in light of the accompanying drawings in which.

DESCRIPTION OF THE PREFERRED EMBODIMENTS

Figure 1:
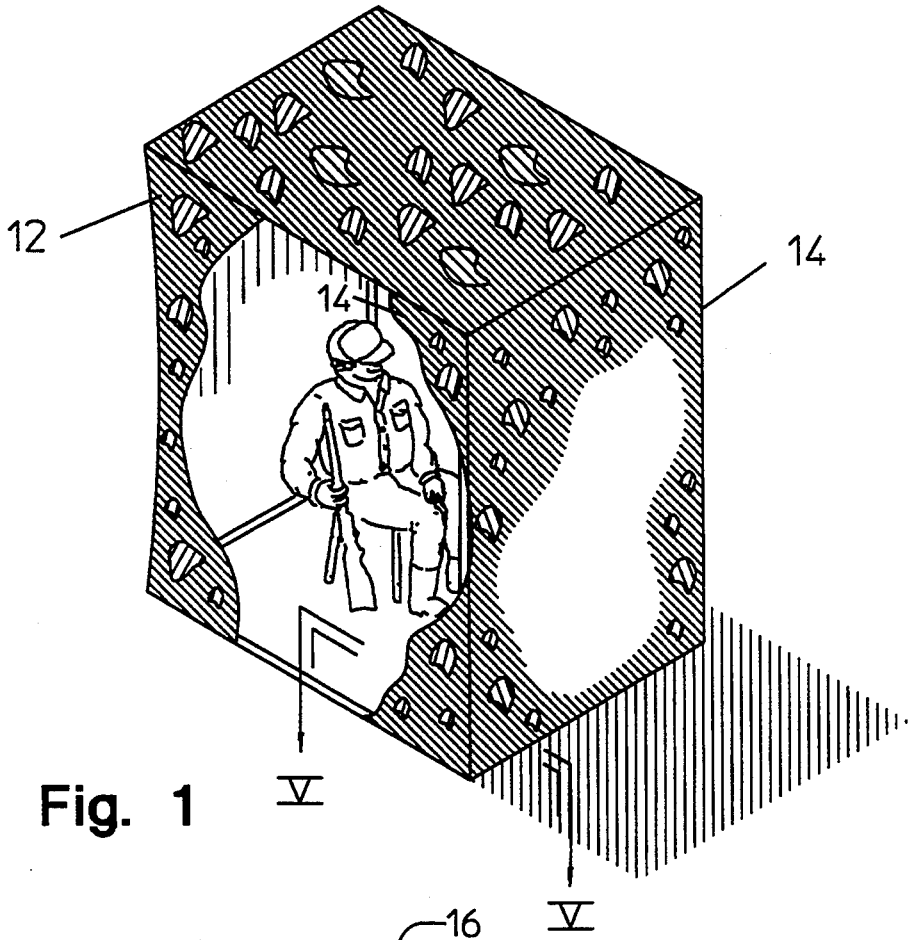
FIG. 1 is an isometric illustration of the blind apparatus according to the present invention.
Figure 2:
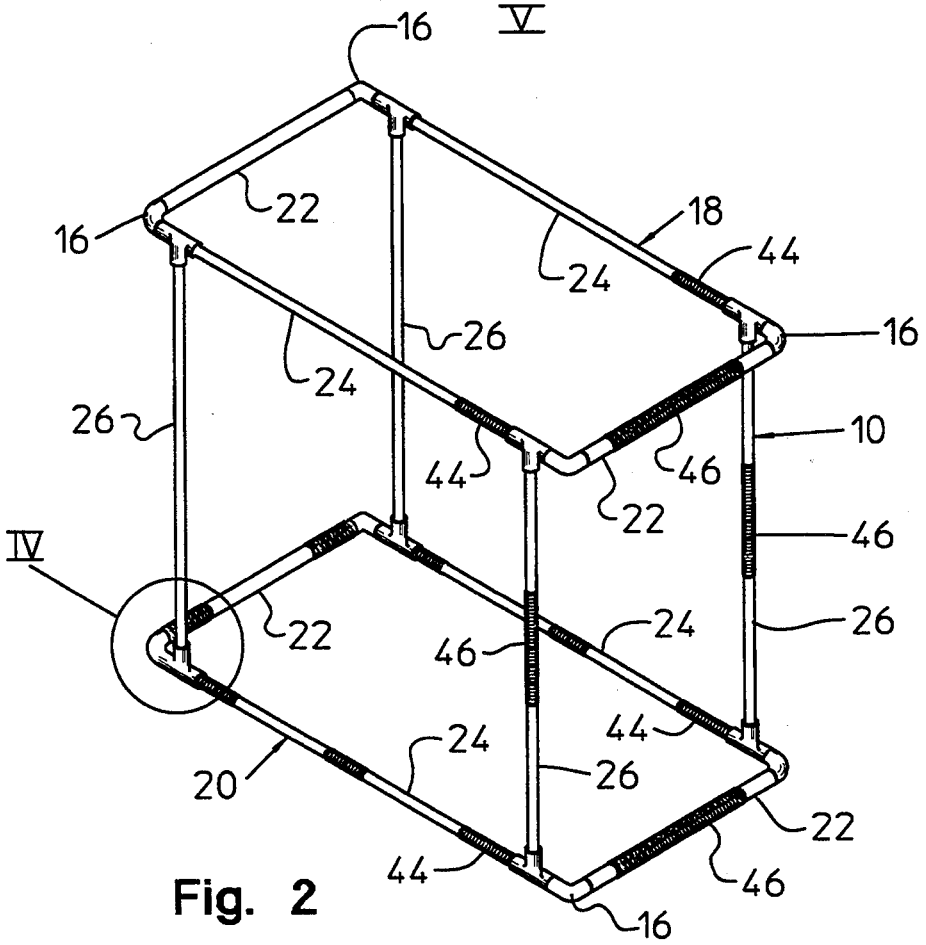
FIG. 2 is an isometric view of a skeletal frame forming part of the camouflage blind of the present invention.
Figure 4:
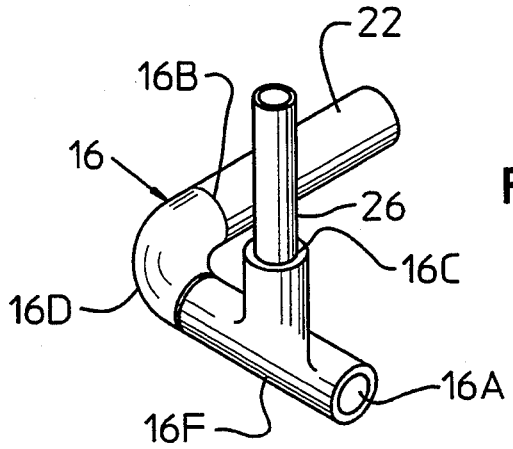
FIG. 4 is a enlarged isometric view of a connector for the skeletal structure shown in FIG. 2.

In FIG. 1 there is illustrated the camouflage apparatus of the present invention which essentially includes a skeletal frame 10 to support a casing 12 and a netting 14. As will be described in greater detail hereinafter, the netting spans a large area defining an observation window of the camouflage apparatus. The skeletal frame as shown in FIG. 2, is made up of tubular connectors 16 that receive by frictional contact spacer bars. As shown in FIG. 4, each tubular connector has three socket openings 16A, 16B and 16C each dimensioned to receive an end portion of tubular spacers. The tubular connector is preferably constructed from the plastic pipe connectors comprising an elbow 16D cemented or otherwise fastened to a tee 16F arranged so that the elbow only forms the outside corner while the tee is situated along the side of the frame. The spacer bars are cut to predetermined lengths to form top and bottom rectangular frame subassemblies 18 and 20. The top subassembly comprises width bars 22 and depth bars 24. The same arrangement of bars is provided at the bottom and therefore the bars are identified by the same reference numerals. The top and bottom rectangular subassemblies when assembled using the connector pieces 26 are held in a spaced apart relation by posts 26 joined by friction in socket openings 16C of the connectors 16. Posts 16 are at the sides of the frame remote to the four corners of the rectangle and define the height of the skeletal structure. The casing 12 is preferably made of water impervious fabric with a camouflage decoration and coloration suitable for use in the natural habitat of wild game. Important, however, is the fact that casing 12 is impervious to visible light so that a person situated in the camouflage area surrounded by the casing cannot be seen by reflected light permeating the casing.

Figure 3:
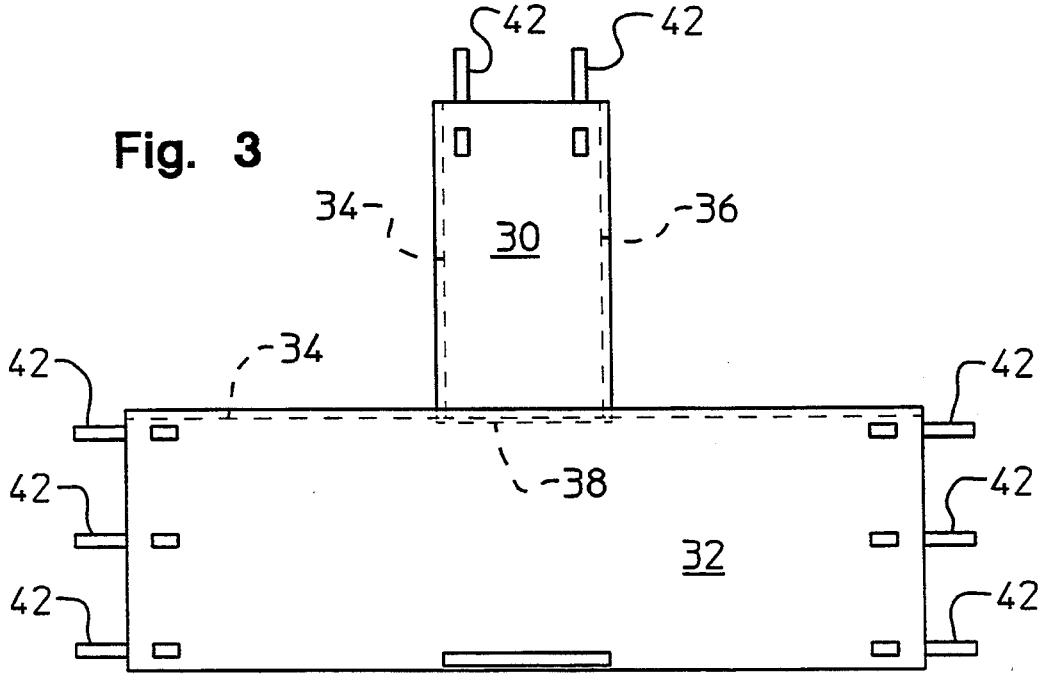
FIG. 3 is a plane view of the casing before sewing.

As shown in FIG. 3 the casing is preferably constructed from two cloth pieces 30 and 32. The length and width of cloth piece 30 are chosen to correspond to the dimensions of the back of the blind. The length and width of cloth piece 32 are chosen to correspond to a first side of the blind beginning at the bottom of the blind then extend, to the top, across the top of the blind and then transverse the opposing sides to the bottom of the blind. The casing pieces 30 and 32 are sewn along to sew lines 34, 36 and 38. Sew line 34 when completed joins together cloth piece 30 and 32 to form one vertical corner at the back of the blind and similarly the other vertical corner of the blind is formed by joining together the cloth pieces at sew line 36. A final sew line 38 connects the cloth pieces 30 and 32 along a line forming the junction between the back and top of the blind. Spaced along the sew lines at sites identified by reference numeral 42 are strips of hook fabric sewn to the casing to wrap around the most immediate adjacent area of the skeletal frame and attached to a sewn-on patch of pile fabric on to the inside face of the casing.

Figure 5:
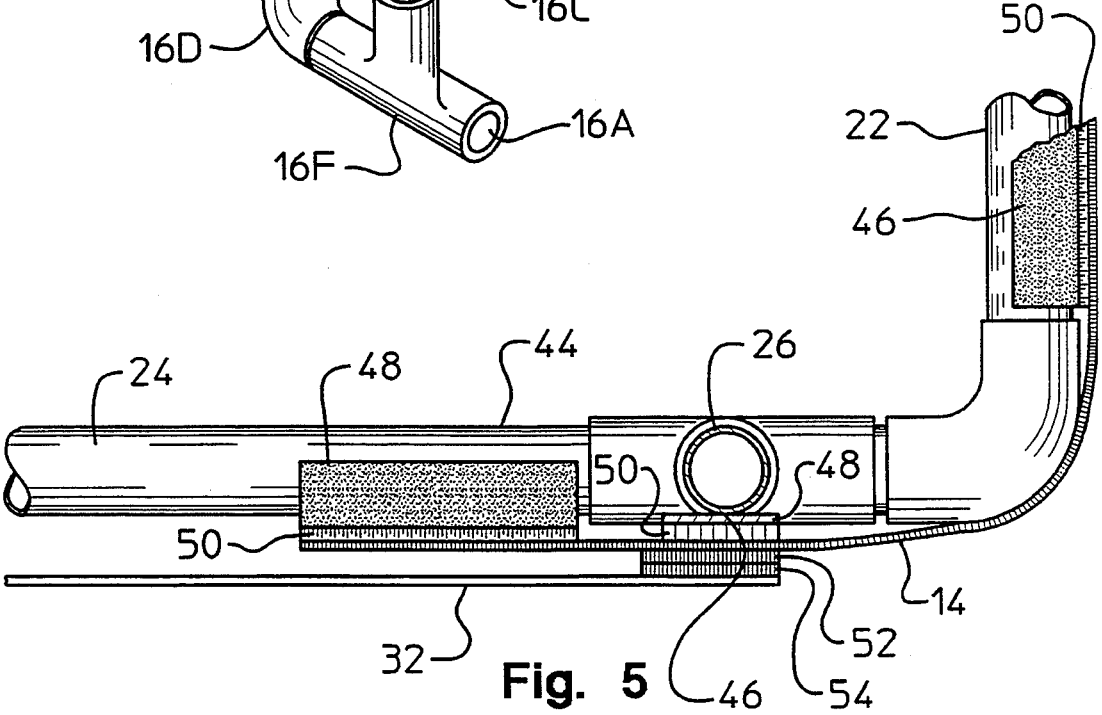
FIG. 5 is an enlarged view taken along line V—V of FIG. 1.

The netting surrounding the entire viewing window is attached to the skeletal frame in a manner shown in FIGS. 1, 2, and 5 which has the additional advantage of obscuring the line of demarcation between the netting and the casing by shifting the parting line a short distance e.g., several inches rearwardly along the sides of the casing. The netting 14 extends across the front and then along side part of the skeletal frame. As shown in FIG. 2 at sites 44 on the top and bottom side rails 24 and at the spaced sites 46 along posts 26 and on the top and bottom from rails 22 there is secured by adhesive a length of hook fabric 48 to releasably receive a patch of pile fabric 50 that is sewn on to a marginal edge part of the netting when stretched out at a site that is directly opposite to the patch of pile fabric on the frame. It can be seen from FIG. 1 that the sites 44 are spaced at a distance much greater than the distance from the corner posts e.g. 7 to 8 inches than the sites 46 on the corresponding corner posts 26. This construction allows fastening the netting with reliably large marginal edges directing to the frame. The netting is held on the frame with the degree of tautness to assure an effective camouflage appearance. A patch 52 of pile is sewn on the outside of netting at each of sites 46 along posts 26. A patch of hook fabric 54 is sewn on to the marginal edge of casing 32. The hook and pile patches 52 and 54 interconnect between the casing and the netting where fastened to frame prevent unwanted shifting and movement of the casing on the frame.

The netting material comprising the front panel allows, among other things, ventilation of the camouflage area and importantly, when desired, penetration of a missile either in the form of an arrow or a ballistic projectile of a fire arm when the person in a blind is engaged in a hunting sport. The netting is preferably provided with camouflage coloration patches. The netting is suitable when provided with openings that are between about 1/16 and 1/32 of an inch. The wide viewing area provided by the netting avoids the disadvantage in the past of small special viewing areas from a camouflage blind. The camouflage coloration is preferable a dark such as black, gray, and green colors which have been found to be effective to avoid of reflection of ambient light from the interior of the camouflage area. By the construction of parts shown in FIG. 5, the netting remains an integral part of the camouflage and ingress and egress is made through separation of hook patches 52 from the pile patches 54 by pressure applied to the marginal edge of the casing.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. A blind apparatus to camouflage persons present in natural habitat of wild game, said apparatus comprising:

a skeletal frame including top and bottom rectangular frame parts vertically spaced by posts for defining a camouflage area for a person, a light impervious casing defining a top, a back and opposed sides supported by said skeletal frame for preventing emission of light by said casing from the camouflage area; and netting attachable for support by said frame to form an enclosure spanning an entire frontal opening formed by said skeletal frame while allowing line of sight through said opening in the netting for visual access to the natural habitat, said netting having a coloration for avoiding reflection of ambient light from interior of said blind.

2. The blind apparatus according to claim 1 wherein said netting includes camouflage color patches.

3. The blind apparatus according to claim 1 wherein said light impervious casing includes camouflage coloration patches.

4. The blind apparatus according to claim 1 wherein said skeletal frame includes rail members joined by connectors.

5. The blind apparatus according to claim 4 wherein said rail means are releasably held by said connectors by friction.

6. The blind apparatus according to claim 1 further including releasable attachment means on said light impervious casing for retaining the casing on said skeletal frame.

7. The blind apparatus according to claim 1 further including releasable attachment means on said netting for releasably retaining the netting on said skeletal frame.

8. The blind apparatus according to claim 1 wherein the top back and opposed said panels are sewn along seam lines for integrally forming top, back and side walls of said casing.

9. The blind apparatus according to claim 1 further including velcro fastening means on each of said side panels and said netting for releasably engaging said posts.

10. The blind apparatus according to claim 1 further including fastening means for releasably securing said top of the light impervious casing to the top of said skeleton with sufficient integrity to allow a person situated in said camouflage area to lift, support and move the apparatus from place to place in a weight sustaining with the roof panel.

11. The blind apparatus according to claim 1 wherein said netting defines open spaces sufficient to allow launch penetration, and flight of a missile from said camouflage with an absence of influence on a trajectory of said missile.

12. The blind apparatus according to claim 11 wherein said netting is held on the skeletal frame with a predetermined tautness.

13. The blind apparatus according to claim 1 wherein said posts extend vertically along said opposed sides.

14. The blind apparatus according to claim 1 further including means for side ingress and egress to and from the interior of the blind at a junction where the netting joins at the side of the blind with the casing.

15. The blind apparatus according to claim 14 wherein said light impervious casing is releasably attached to side of said netting for side ingress and egress to and from the interior of said blind while the netting remains attached to the skeletal frame.

* * * * *